United States Patent [19]

Lee

[11] Patent Number: 4,605,261

[45] Date of Patent: Aug. 12, 1986

[54] FOLDABLE PORTABLE RECLINING CHAIR

[76] Inventor: Ching C. Lee, No. 281, Cheng Te Rd., Taipei, Taiwan

[21] Appl. No.: 687,240

[22] Filed: Dec. 28, 1984

[51] Int. Cl.[4] ..... A47C 4/00

[52] U.S. Cl. ..... 297/16; 297/457; 297/17

[58] Field of Search ..... 297/16, 19, 441, 457, 297/17

[56] References Cited

U.S. PATENT DOCUMENTS 4,047,752 9/1977 Rohr ..... 297/16

4,258,951 3/1981 Groom ..... 297/16

FOREIGN PATENT DOCUMENTS 2025213 1/1980 United Kingdom ..... 297/16

*Primary Examiner*—Francis K. Zugel

*Attorney, Agent, or Firm*—Armstrong, Nikaido, Marmelstein & Kubovcik

[57] ABSTRACT

A foldable portable reclining chair composed of a soft material tent-type chair face and a stable chair frame body, wherein said stable chair frame body is composed of a plurality of support racks each in a proper length to be connected with a retractable joining device. Thus, when the user wants to fold and pack the chair up, he may draw the support racks along the pre-set direction away from the joining seat of the support rack body, fold the frame up and set the connection support racks parallelly to each other against the support rack body. The folded frame can be tied together into a smaller volume. Thus, the carrying or transporting and folding of the reclining chair become simpler and easier than that of the conventional reclining chairs.

1 Claim, 7 Drawing Figures

FOLDABLE PORTABLE RECLINING CHAIR

BACKGROUND OF THE INVENTION

Due to the changes of modes of the society nowadays, people favor open-air activities to spend their leisure time. Therefore, instruments suitable for open-air activities have been ever changing and renewing to meet the timely requirements. The main defect of the open air actitivies is that most of the required instruments are inconvenient to be carried by the users themselves. In particular, most of the inclining instruments are either bulky or large in volume and not suitable for the participants themselves to carry. Considering the ground, generally it is rather hard to find a flat area suitable for sitting and lying down. Thus, it is of necessity to design an instrument that is easy to carry and that the user can lie thereon in the openair.

SUMMARY OF THE INVENTION

One object of the present invention is to provide a reclining foldable portable chair which can be assembled or folded up in a simple and easy manner making it easily to be carried outdoors and suitable for sitting and lying thereon.

Another object of the present invention is provide a foldable chair which can recline support rack body of which can be folded into a self-contained unit and which are unlike foldable reclining chair into still and attached status to conventional folding reclining chairs that, after being folded and packed, are completely separated. When reassembling, the present foldable reclining chair can be assembled in a reverse sequence without any troubles and inconveniences. After the reclining chair is assembled or folded and packed up, it remainer a complete indentity unit without the defects of component parts of conventional similar chairs where parts are easy to fall out and be lost.

Other objects, features and effects of the present invention would be further understood from the following detailed description with the accompanied drawings.

DETAILED DESCRIPTION OF THE PRESENT INVENTION

Figure 1:
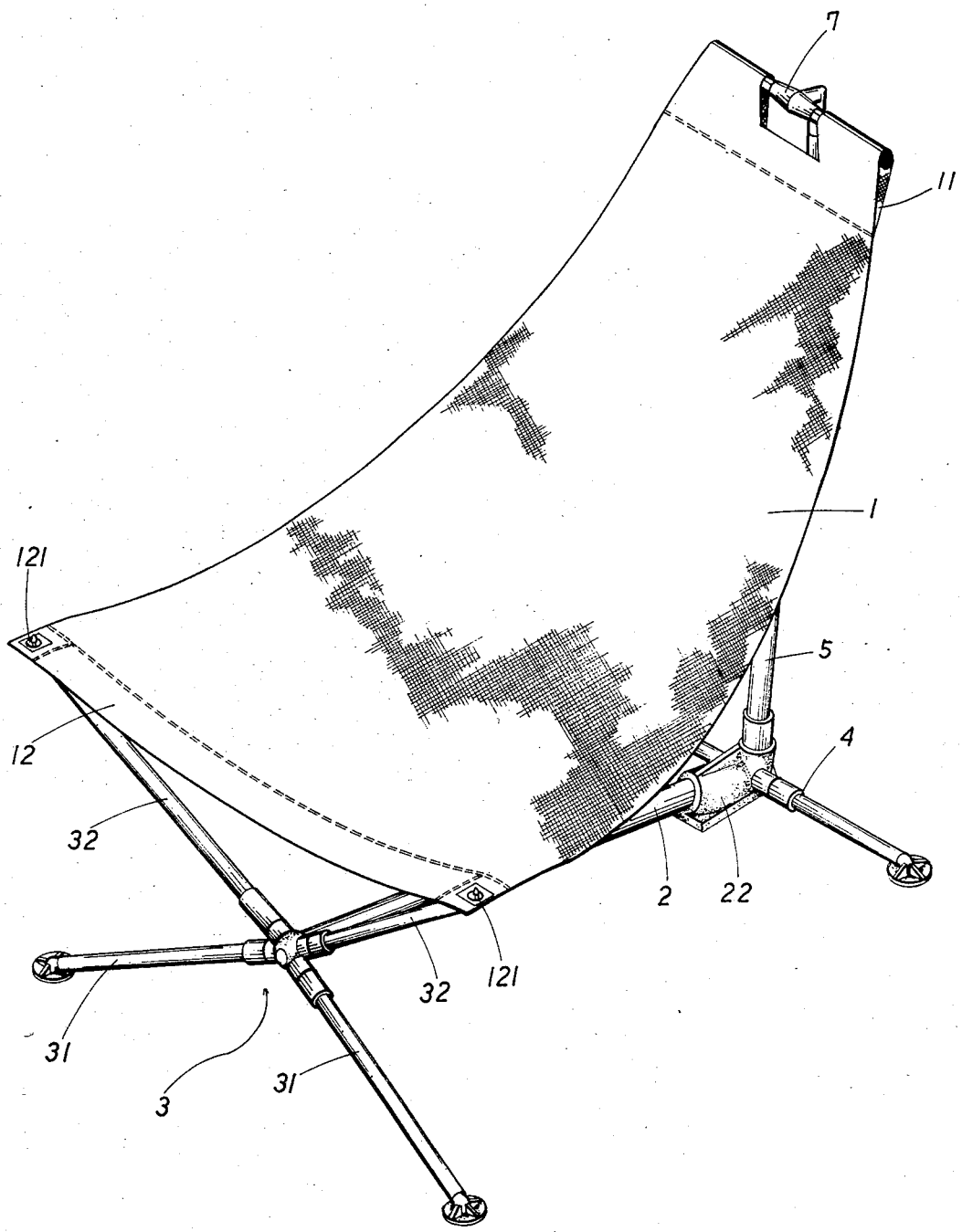
FIG. 1 is a perspective view of the folding chair of the present invention.

Referring to the drawings, the chair of the present invention comprises a chair face 1 which is composed of a soft fabric body. The upper selvedge of the fabric is sewn into a through hole pocket 11. The lower fabric selvedge is made into a sewn rim 12 with a button hole 121 at each of the ends of the sewn rim 12 respectively.

A chair frame, comprising main frame rod 2, front fork rod 3, rear leg rod 4 and back support rod 5 generally designate. Main frame rod 2 straddles between the front fork rod 3 and rear leg rod 4. At the front end of main frame rod 2 front fork link rods 21, the fork link rods are attached to frame rod 2 forming a proper angle between each other. The rear end of main frame rod 2 is provided with a support rack seat 22. Support rack seat 22 is connected with a main frame rod 2 along a proper angle of elevation. The bottom of rack seat 22 is flat, and its top is vertically provided with a link rod 221 to connect with back support rod 5. The sides of support rack seats 22 at provided horizontally with link rods 222, respectively in an extended manner (please refer to FIG. 3) to connect with rear legs 4 respectively. The front fork rod 3 includes two front legs 31 and two front bracing rods 32, inserted into sleeves 311,321, respectively. The other end (bottom) of front legs 31 are provided with a foot seats 33. The end of front bracing rods 32 are provided with convex buttons 322 respectively to receive button holes 121 in chair face.

One end of rear leg rods 4, wherein the insertion sleeve 41 on one end of rear leg rod 4 is to accommodate link rods 222 on both sides of support rack seat 22 to be inserted and joined therein, is inserted into sleeve 41 while the other end of rods 4 are connected to foot seats 42 respectively.

Figure 2:
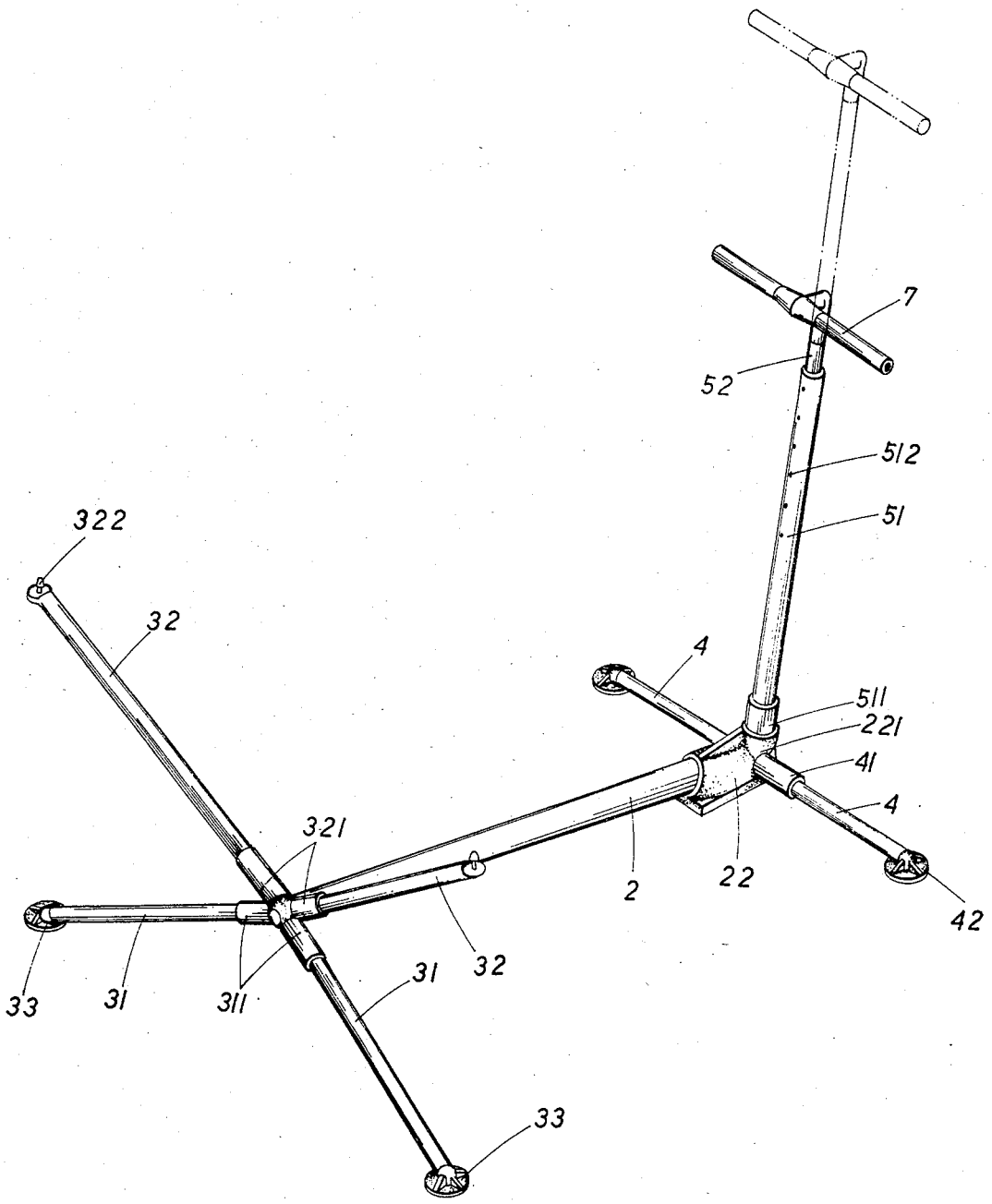
FIG. 2 is similar view of the support rack body of such chair.
Figure 5:
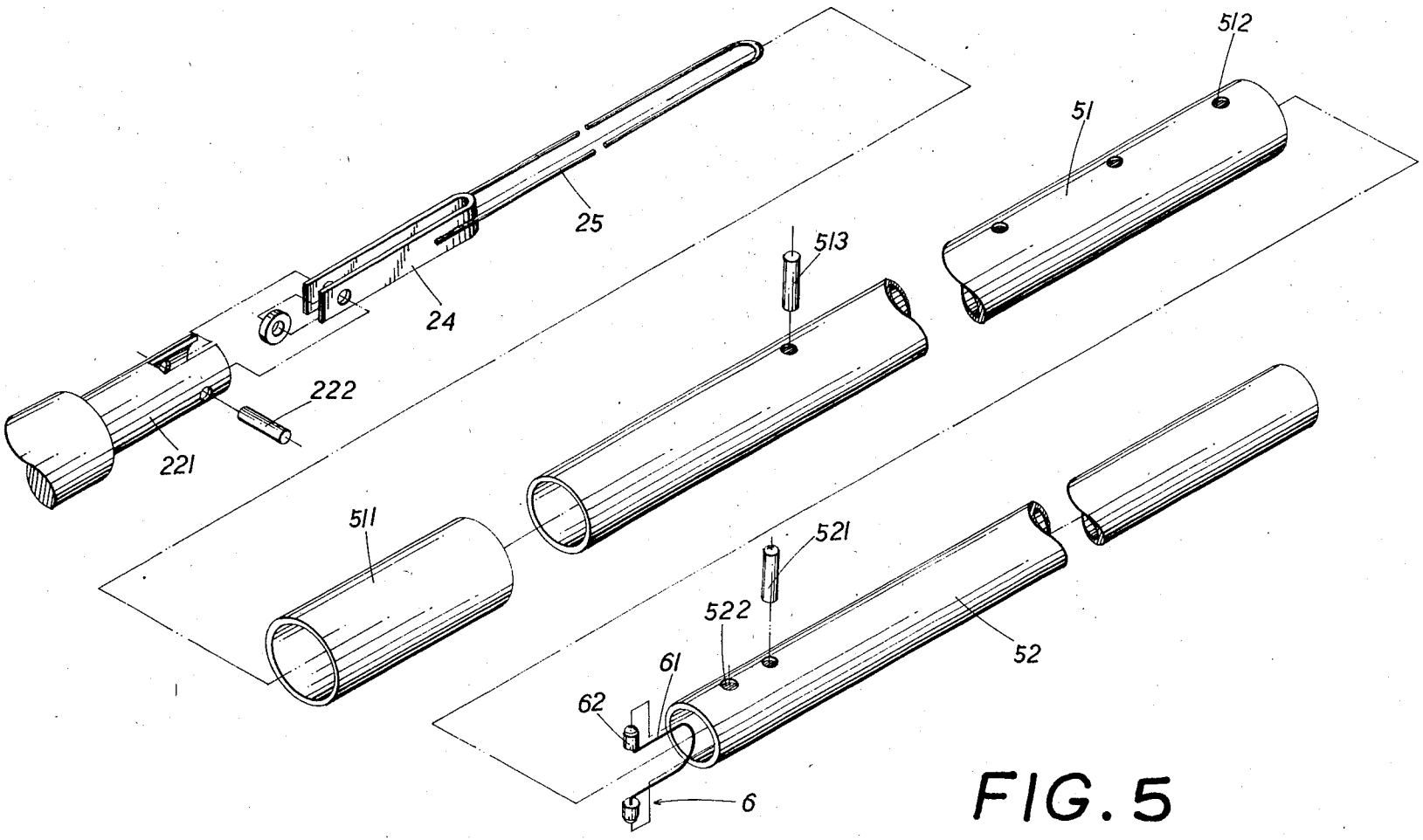
FIG. 5 is an exploded showing the joining part between the back support rod and the support rack seat of the chair of the present invention.
Figure 6:
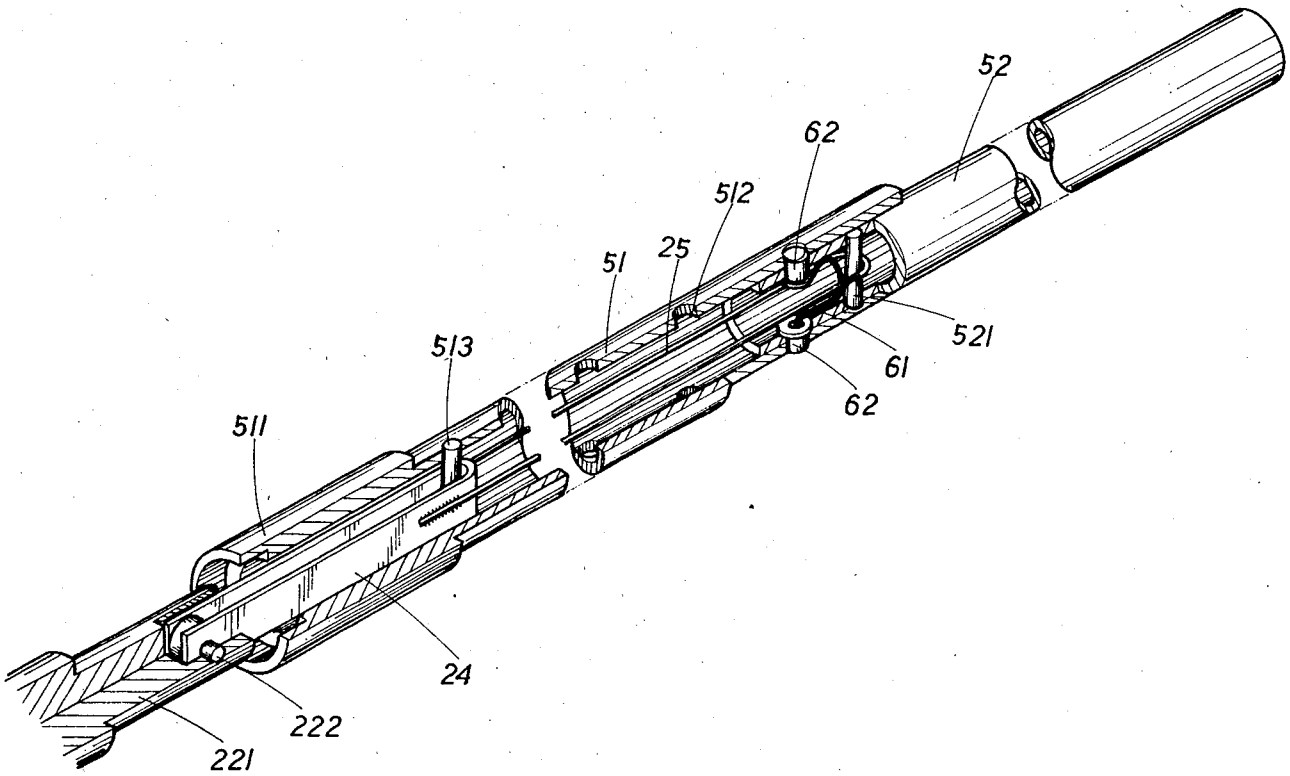
FIG. 6 is a partly in section, view, showing the back support rod and the support rack seat of FIG. 5 with the part assembled.

Back support rod 5 is a dual-type tube with an inner tube 52 and outer tube 51, FIG. 2. The bottom of outer tube 51 FIGS. 5 and 6, is made in a form of insertion sleeve 511 to be sleeved over and connected to link rod 221, while inner tube 52 slides in and matches the outer tube 51. Catch key 6 installed in a key hole 512 provided sidewisely in the outer tube 51 is matched to make the inner tube fixedly joined on said outer tube, after the inner tube 52 is pulled out in a proper length from the outer tube 51. A plurality of key holes 512 may be provided in tube 51 to make the upward pulled length of the inner tube 52 become properly adjustable. A T-shaped chair face rack 7 is joined on the top of the inner tube 52 to penetrate through support, and stretch a through pocket 11 of said chair face for supporting and stretching the chair face 1.

Figure 3:
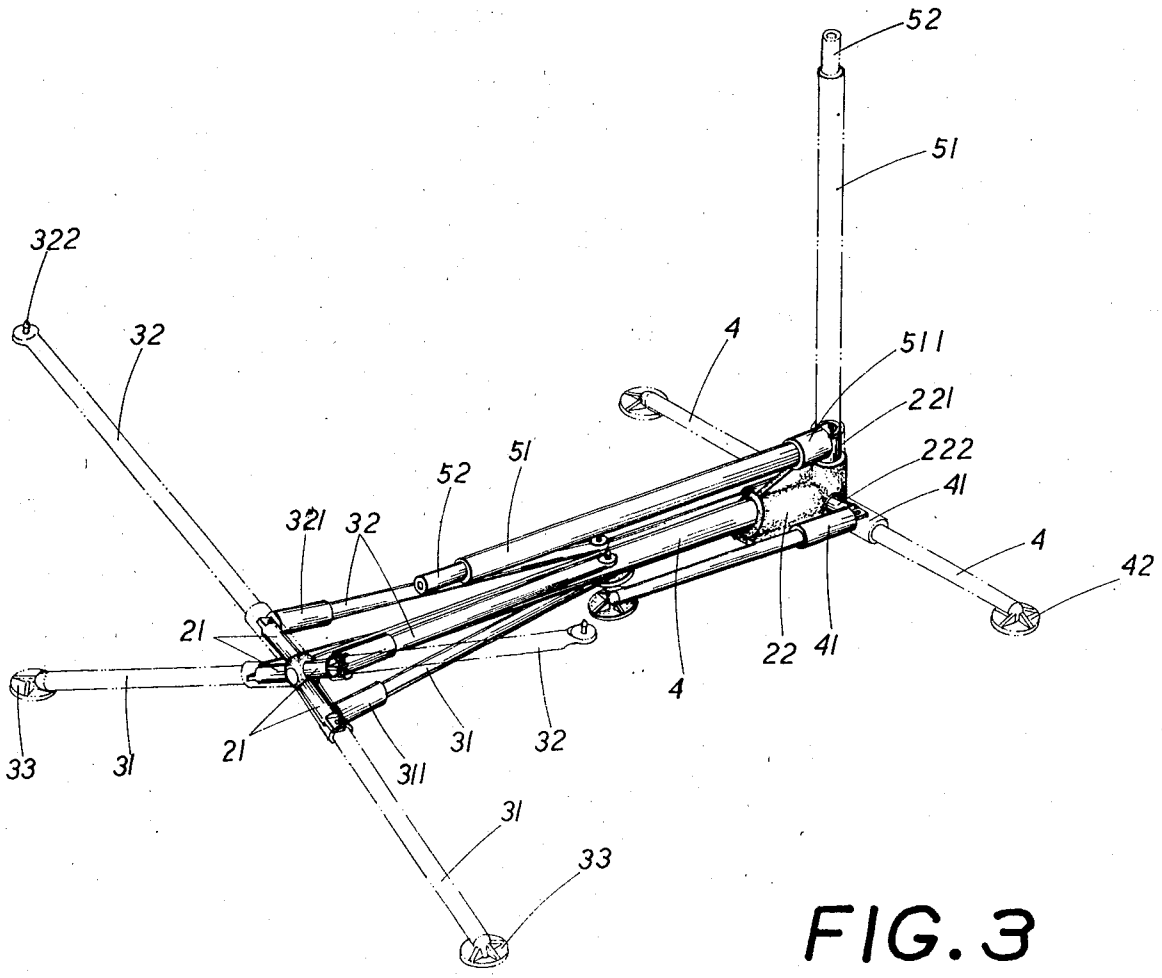
FIG. 3 is a graphic view of the chair of the present invention when folding.
Figure 4:
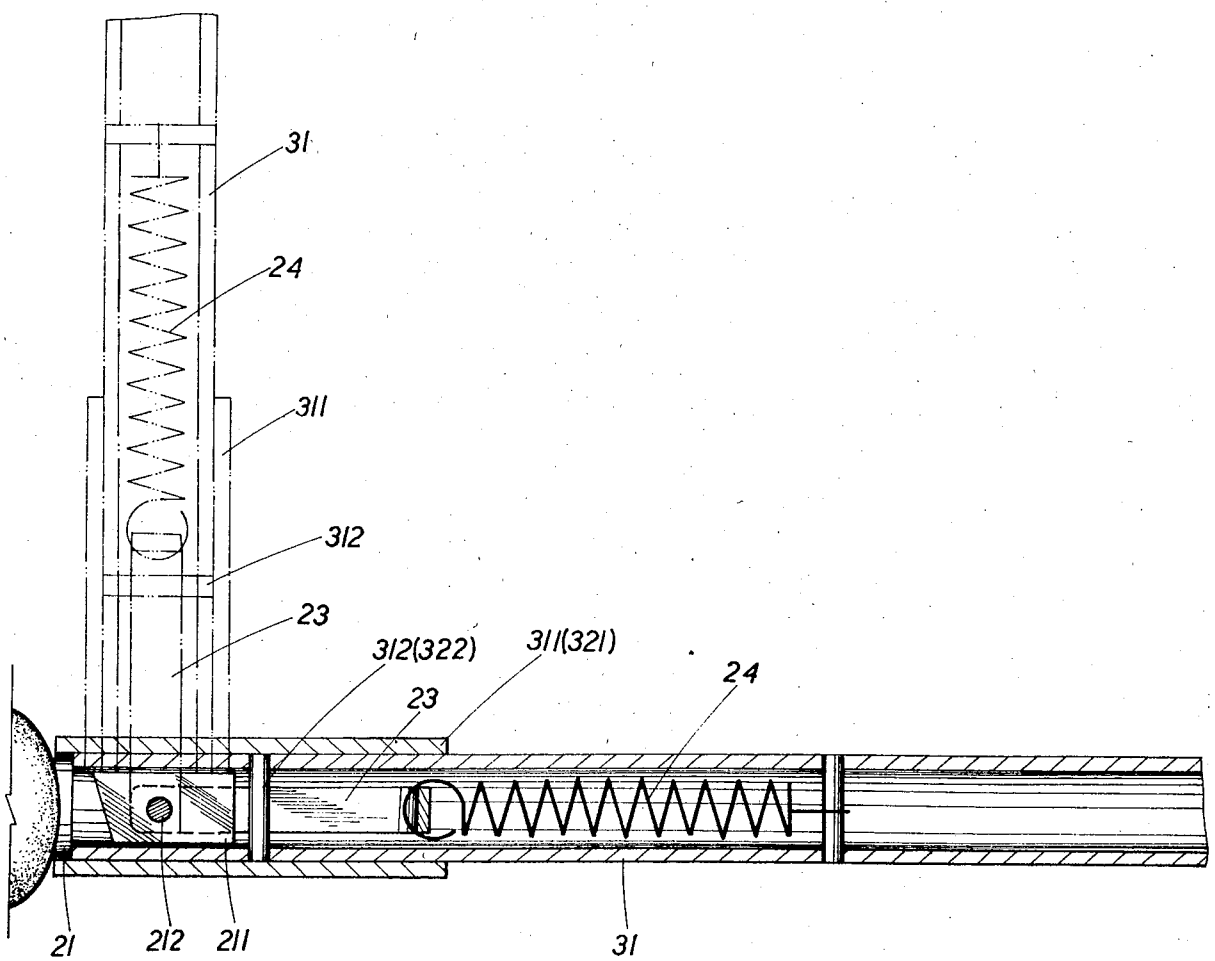
FIG. 4 is the cross sectional view showing the joint between the leg support rack and the main frame of the present invention.

Referring to FIG. 3 and FIG. 4, the joining way of front fork rod 3 and rear leg rod 4 and main frame rod 2 is such that a front connection plate 211, FIG. 4 with a hole 212 is provided on the front end of link rod 21 (22) fixed set on main frame rod 2. A U-shaped catch ring 23 is pivoted in hole 212. Spring 24 is hooked at one end on catch ring 23 and at its other end on pin 310 in front leg 31. Stop pin 312 (322) is sidewisely straddled in the inner part of insertion sleeve 311(321) of front fork rod 3 and rear leg rod 4 to penetrate through the space in the ring of the U-shaped catch ring 23, thereby preventing catch ring 23 from slipping off the respective ends of the various rods. This structure draws support rods along the axial direction of link rods 21, (22), allowing insertion sleeve 311 (321) of various support rods to slip off front connection plate 211 of link rod 211. The various support rods are bent and folded 90° (positions indicated by the imaginery lines) with hole 212 as the center of rotation.

Referring to FIG. 5 and FIG. 6, the joining of back support rod 5 and inner/outer tube (51,52) and of back support rod 5 and support rack seat 22 are now described.

U-shaped catch ring 24 is pivoted on pin 222 in the front of link rod 221. U-shaped metal wire 25 is welded to the front end of U-shaped catch ring 24 and is inserted into the inner/outer tube (51,52). Pin 513 is passed through and installed in the space within the ring of U-shaped catch ring 24 to limit movement of U-shaped catch ring 24, so that the lower end of outer tube insertion sleeve will not slip off the the U-shaped catch ring 24 while back support rod 5 is drawing along the axial direction of link rod 221. Insertion pin 521 in the end of the inner tube 52 penetrate through the space in the U-shaped metal wire, thus preventing the inner tube 52 from slip off while drawing and extending the length along the outer tube 51. Double-edge key hole 512 passes through outer tube 51. Key hole 522 passes the tail end of inner tube 52, a catch key 6 is provided in said key hole 522. Catch key 6 is formed by two post-shaped key blocks 62 supported and stretches a U-shaped elastic wire. When inner tube 52 is pulled and extended upward, catch key 6 and key hole 512 match to fix the inner/outer tubes. A plurality of key holes 512 can be provided to make the extended length of the inner tube adjustable. Back support rod 5 can be drawn along the axial direction of the extended link rod 221, thus making the link rod 221 slip off insertion sleeve 511 of the outer tube, and fold 90° with pin 222 pivotally connected between link rod 221 and U-shaped catch ring 24 as its center of rotation.

When insertion sleeve parts of the various support racks are joined with the insertion sleeves of the various link rods, a firm chair frame body is formed. The sewn hole pocket 11 of pre-arranged chair face 1 is set on T-shaped chair face frame 7, and the two button holes 121 are buttoned and joined on convex buttons 322 of front bracing rods 322. The back support rod 5 is used to adjust the stretched height of chair face 1. A comfortable reclining chair is this provided.

The foldable reclining chair of the instant invention is easily foldable and compactly collapsible for carrying and storing and is easily unfoldable, erectable and adjustable for use. To fold and collapse the chair, T-shaped face rack 7, with pocket 11 of chair face 1 thereon is removed from the upper end of tube 52 and bottom holes 121 at the opposite ends of sewn rim 12 are slipped off of bottoms 322 at the ends of front bracing rods 32, first legs 31, rear legs 4 and back support rod 5, made up of inner tube 52 and outer tube 52, are folded into and substantially parallel with main frame rod 2 as best shown in FIG. 3.

Starting with bracing rods 32 and front legs 31, rods 32 and legs 31, FIG. 4, each rod and leg, respectively, is drawn axially of link rod 21, against the tension of spring 24 to allow sleeve 311 of the rod or leg, as the case may be, to slip off the outer end of plate 211. The rod or leg is then pivoted folded into main frame rod 2, FIG. 3 and released. The tension of spring 24 in each rod and leg, draws these rods and legs, once pivoted, and folded into engagement with the side of plate support rods 32 folded. Rear leg rods 4 are similirly attached, at sleeves 41 to link rods 222 on support rack seat 22, FIG. 3, and are drawn, or extended, in the same manner as front legs 32 and bracing rods 32 and are pivoted, folded into main frame rod, 2, FIG. 3, and released.

As best shown in FIGS. 5 and 6, inner tube 52 of back support outer tube 51 may be telecopied into outer tube 5 by adjusting catch key 6 in holes 512 of outer tube 51 and pin 521 in holes 522 of inner tube 52. In either event, to fold back support rod 5 into substantially parallel folded position with main frame rod 2, support rod 5 is pulled out or extended in the axial direction to slip sleeve 511 on outer tube 51 outwardly off of link rod 221. With sleeve 511 extended beyond the end of rod 222, support rod 5 is pivoted inwardly, FIG. 3, to position substantially parallel to main frame rod 2 and, when support rod is released, is drawn into locked position.

Figure 7:
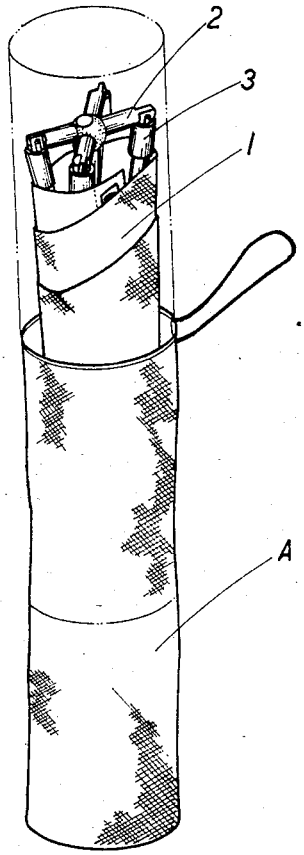
FIG. 7 is a perspective view showing the chair folded and packed up in a storage bag.

With the frame folded and collasped, FIG. 3, chair face 1, with T-shaped rack 7 in pocket 11 thereof, is wrapped around the folded frame and may be tied or slipped into storage bag A, FIG. 7.

The folded reclining chair of the present invention is unfolded, erected and assembled in a similiar convenient manner. After the folded assembly is removed from bag A, FIG. 7, and chair face 1 with face rack 7 in pocket 11 thereof, is unwrapped from the folded assembly and set aside. Back support 5 is pulled or extended outward, to release the end of sleeve 511 from abutment with the side of link rod 221, support rod 5 is pivoted upward into position above the end of link rod 221 and support rod 5 is released allowing sleeve 511 to drop down over link rod 221 and lock back support rod 5 in position. Rear legs rods 4, front legs 31 and front bracing rods 32 are each similiarly extended, pivoted into alignment with respective plates 211 and released sleeve 41 on rear leg rods 4 and sleeves 311 on front legs 31 and front bracing rods 32. The sleeves 41 and 311 respectively, slip over plate 211 as the legs and bracing rods are each released, locking the frame in its unfolded, erected condition. The end of face rack 7 in pocket 11 of chair face 1 is slipped into the upper end of inner tube rod 52 and bottom holes 121 at the opposite ends of sewn rim 12 are slipped over buttons 322 at the ends of bracing rods 32. Before this is done, the height of back support rod 5 may be adjusted by adjusting inner tube 52 in outer tube 51, as already described, or such back adjustment may be made better.

As apparent from the foregoing description and the folding and unfolding operation, the reclining chair of the present invention is easy to fold and unfold and easy to carry and store.

The terms and expressions which have been employed in the foregoing description are used as terms of description and not of limitation and there is no intention, in the use of such terms and expressions, of excluding any equivalents of feature shown and described or portions thereof, but it is recognized that various modifications are possible within the scope of the invention claimed.

I claim:

1. A foldable portable reclining chair having a chair face and a foldable frame, said chair face being of fabric and having an upper selvege with a through hole pocket and a lower sewn rim with a button hole near each of the ends of said sewn rim; said chair frame comprising a main frame rod; front fork link rods fixedly attached to the front end of said main frame rod and rear leg rods and a back support rod pivotally attached to a support seat on the rear end of said main frame rod, said support seat having a seat surface vertical link rod extending upwardly from said support seat and horizontal link rods extending outwardly from said support seat from the opposite sides of said support seat and from the opposite sides of said main frame rod, means pivotally attaching one end of said back support rod to said vertical link rod, sleeve means slidable on said back support rod and over said vertical link rod for locking said back support rod in fixed vertical position when said sleeve means is over said pivotally attaching means on said back support rod to said vertical link rod and for allowing said back support rod to be pivoted when said sleeve means is raised above said pivotally attaching means, means on each of said horizontal link rods for pivotally attaching each of said rear leg rods to said horizontal link rods, respectively, and for locking said respective rear legs in horizontal fixed position when said chair is unfolded, a pair of front leg rods and a pair of front bracing rods, means for pivotally attaching each of said front leg rods and each of said front bracing rods, respectively, at one of their ends to one of said front link rods, for pivoting said front leg rods and said front bracing rods on said front fork link rods and for preventing said leg rods and said bracing rods from being pivoted and means on said back support rod and said front bracing rods for attachment to said hole pocket and said button holes in said chair face, Said means for pivotally attaching said rear legs to said horizontal link rods and said front leg rods and front bracing rods to said front fork link rods including a U-shaped catch ring, a spring hooked and provided on said ring, a stop pin extending through said U-shaped ring and means for elongating said spring when said rods are extended for pivotal movement and for contracting said spring when said rods are released for preventing pivotal movement.

* * * * *